US008302513B2

(12) United States Patent
Evatt

(10) Patent No.: US 8,302,513 B2
(45) Date of Patent: Nov. 6, 2012

(54) SCREW GUIDE

(75) Inventor: Thomas Evatt, Six Mile, SC (US)

(73) Assignee: Techtronic Power Tools Technology Limited, Tortola (VG)

( * ) Notice: Subject to any disclaimer, the term of this patent is extended or adjusted under 35 U.S.C. 154(b) by 328 days.

(21) Appl. No.: 12/717,476

(22) Filed: Mar. 4, 2010

(65) Prior Publication Data

US 2010/0224038 A1 Sep. 9, 2010

Related U.S. Application Data

(60) Provisional application No. 61/157,734, filed on Mar. 5, 2009.

(51) Int. Cl.
*B25B 23/08* (2006.01)
*B25B 23/12* (2006.01)

(52) U.S. Cl. ..... 81/451; 81/177.2

(58) Field of Classification Search ..... 81/451, 81/452, 454, 177.2, 177.85; 403/315–320
See application file for complete search history.

(56) References Cited

U.S. PATENT DOCUMENTS

| | | | | | |
|---|---|---|---|---|---|
| 79,509 | A | | 6/1868 | Smith | |
| 729,830 | A | | 6/1903 | Yates | |
| 1,457,457 | A | | 6/1923 | Peyer | |
| 1,779,339 | A | | 10/1930 | Sokoloff | |
| RE23,201 | E | | 2/1950 | Price | |
| 2,840,126 | A | | 6/1958 | Schmitt | |
| 3,056,441 | A | | 10/1962 | Helms | |
| 3,222,959 | A | * | 12/1965 | Clark | 81/124.6 |
| 3,739,825 | A | * | 6/1973 | Knox | 81/451 |
| 3,965,950 | A | | 6/1976 | MacDonald | |
| 3,971,421 | A | | 7/1976 | Damratowski | |
| 4,016,913 | A | | 4/1977 | Anderson | |
| 4,140,161 | A | * | 2/1979 | Russo et al. | 81/451 |
| 4,237,946 | A | | 12/1980 | Leitner | |
| 4,856,388 | A | * | 8/1989 | Freeman | 81/177.2 |
| 5,448,930 | A | * | 9/1995 | Miner et al. | 81/57.39 |
| 5,470,180 | A | * | 11/1995 | Jore | 408/239 R |
| 5,671,642 | A | | 9/1997 | Haas | |
| 5,791,207 | A | | 8/1998 | Ahdoot | |
| 5,934,384 | A | * | 8/1999 | Wang | 173/132 |
| 5,974,919 | A | * | 11/1999 | Habele | 81/470 |
| 5,996,452 | A | * | 12/1999 | Chiang | 81/429 |
| 6,116,125 | A | | 9/2000 | McLeod | |
| 6,128,982 | A | | 10/2000 | Gwin, Sr. | |
| 6,497,166 | B1 | | 12/2002 | Fleckenstein | |
| 6,530,299 | B1 | * | 3/2003 | Liu | 81/451 |
| 6,543,317 | B1 | | 4/2003 | Rinner et al. | |
| 6,860,178 | B2 | * | 3/2005 | Wang | 81/177.2 |
| 7,210,382 | B2 | * | 5/2007 | McCracken | 81/429 |
| 7,374,377 | B2 | * | 5/2008 | Bauman | 408/239 R |
| 2007/0051216 | A1 | * | 3/2007 | Chen | 81/438 |
| 2008/0289459 | A1 | * | 11/2008 | Yablon | 81/451 |

* cited by examiner

*Primary Examiner* — David B Thomas
(74) *Attorney, Agent, or Firm* — Michael Best & Friedrich LLP

(57) ABSTRACT

A fastener guide includes a shaft having a first end for transferring torque to a fastener and a second end for receiving a torque from an external source, the shaft including a threaded portion and an axial groove extending axially along the threaded portion. The fastener guide also includes a sleeve slidable axially with respect to the shaft, the sleeve having a first end proximate the first end of the shaft and a second end proximate the second end of the shaft, and a depth-adjustment ring having a threaded inner surface for engaging the threaded portion of the sleeve and a detent ring for selectively engaging the axial groove.

17 Claims, 7 Drawing Sheets

SCREW GUIDE

CROSS-REFERENCE TO RELATED APPLICATION

This application claims priority to U.S. Provisional Patent Application Ser. No. 61/157,734 filed on Mar. 5, 2009, the entire contents of which are incorporated herein by reference.

BACKGROUND

The present invention relates to devices that aid in the insertion of fasteners into materials, such as screw guides.

Guide devices are used to insert a fastener, such as a screw, a known or predetermined depth into a material. Inserting the screw a known depth into the material can be critical when it is important to avoid inserting the screw too deep into the material. For example, when it is important to prevent the screw from extending through the opposite side of the material when the material is thinner than the length of the screw, or to prevent fracturing brittle material when the screw extends through a majority of a depth of the material. Further, it is often desired to insert a screw into a material such that the screw head does not contact the material surface that the screw is extended into, for example, when the screw head is at a "stand off height" from the material surface. Further, in some applications it is important to have multiple screws of the same length inserted into a material with each having the same stand off height above the material.

SUMMARY

In one construction, the invention provides a fastener guide including a shaft having a first end for transferring torque to a fastener and a second end for receiving a torque from an external source, the shaft including a threaded portion and an axial groove extending axially along the threaded portion. The fastener guide also includes a sleeve slidable axially with respect to the shaft, the sleeve having a first end proximate the first end of the shaft and a second end proximate the second end of the shaft, and a depth-adjustment ring having a threaded inner surface for engaging the threaded portion of the sleeve and a detent ring for selectively engaging the axial groove.

In another construction, the invention provides a fastener guide including a shaft having a first end for transferring torque to a fastener and a second end for receiving a torque from an external source, the shaft including a threaded portion and an axial groove extending axially along the threaded portion. The fastener guide also includes a sleeve slidable axially with respect to the shaft, the sleeve having a first end proximate the first end of the shaft and a second end proximate the second end of the shaft, a depth-adjustment ring having a threaded inner surface for engaging the threaded portion of the sleeve, and an anti-rotation ring disposed between the sleeve and the depth-adjustment ring and having a locating tab disposed in the axial groove for inhibiting rotation of the anti-rotation ring.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it should be understood that the phraseology and terminology used herein are for the purpose of description and should not be regarded as limiting.

Figure 1:
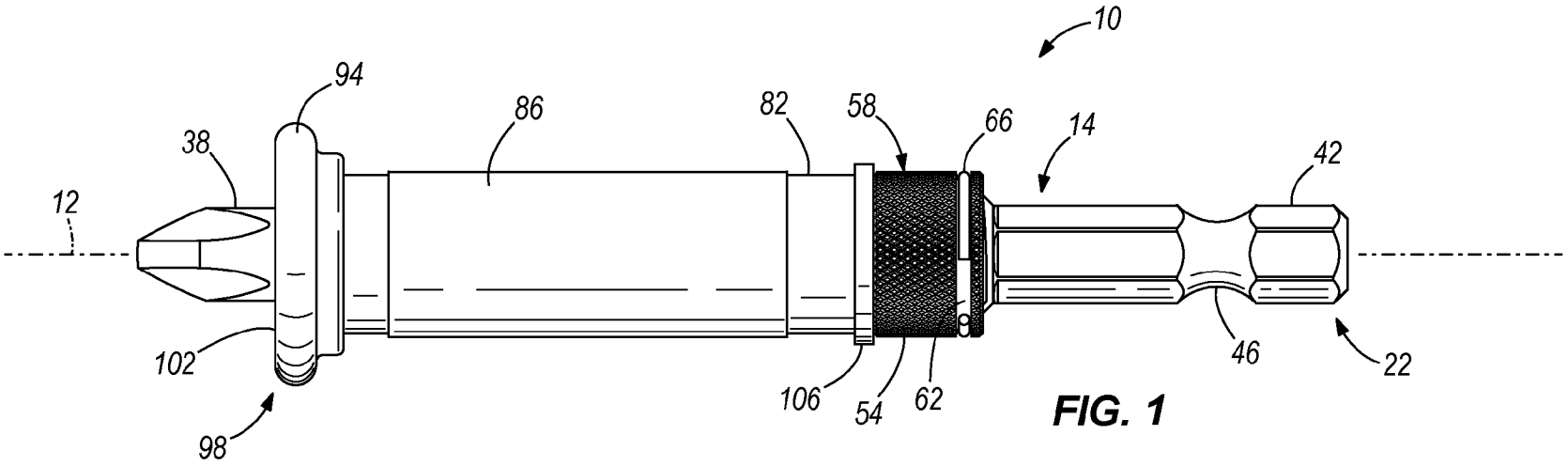
FIG. 1 is a side view of an auto-stop screw guide in a retracted position.
Figure 2:
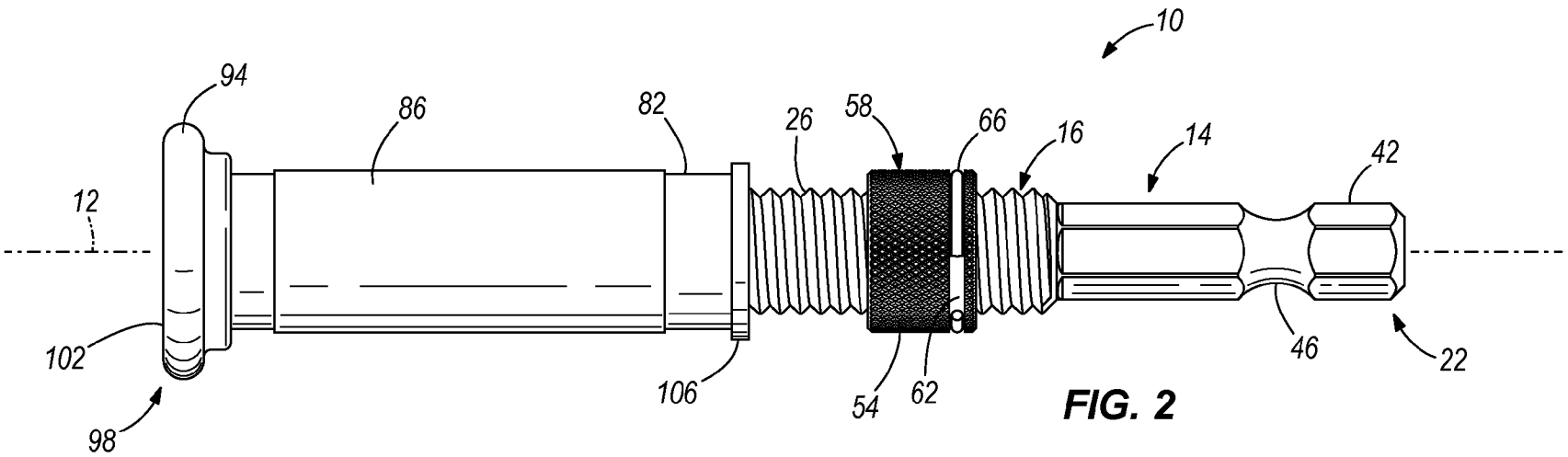
FIG. 2 is a side view of the screw guide in an extended position.

FIGS. 1-2 illustrate an auto-stop screw guide 10 according to one construction of the invention. The screw guide 10 includes a shaft 14, a depth-adjustment ring 54 threadingly coupled to the shaft 14, a sleeve 82 slideably coupled to the shaft 14, an anti-rotation ring 106 disposed between the depth-adjustment ring 54 and the sleeve 82, and a non-mar-ring cap 94 coupled to the sleeve 82, as will be described in greater detail below. The screw guide 10 defines a central axis 12 and is moveable along the central axis 12 between a retracted position, in which the sleeve 82 engages the anti-rotation ring 106 and the screw guide 10 has a first overall length, and an extended position, in which the sleeve 82 is extended away from the anti-rotation ring 106 and the screw guide 10 has a second overall length greater than the first overall length. FIGS. 1, 3, 5 and 7 show the screw guide 10 in the retracted position and FIGS. 2, 4, 6 and 8 show the screw guide 10 in the extended position.

The shaft 14 is for receiving torque from an external source, such as a drill or electric screwdriver, and transmitting the torque to a fastener, such as a screw, bolt, or the like, to drive the fastener into a material, or workpiece. The shaft 14 includes a threaded cylindrical portion 16 and a hexagonal shank portion 42 for coupling the screw guide 10 to a chuck (not shown) of a drill.

Figure 3:
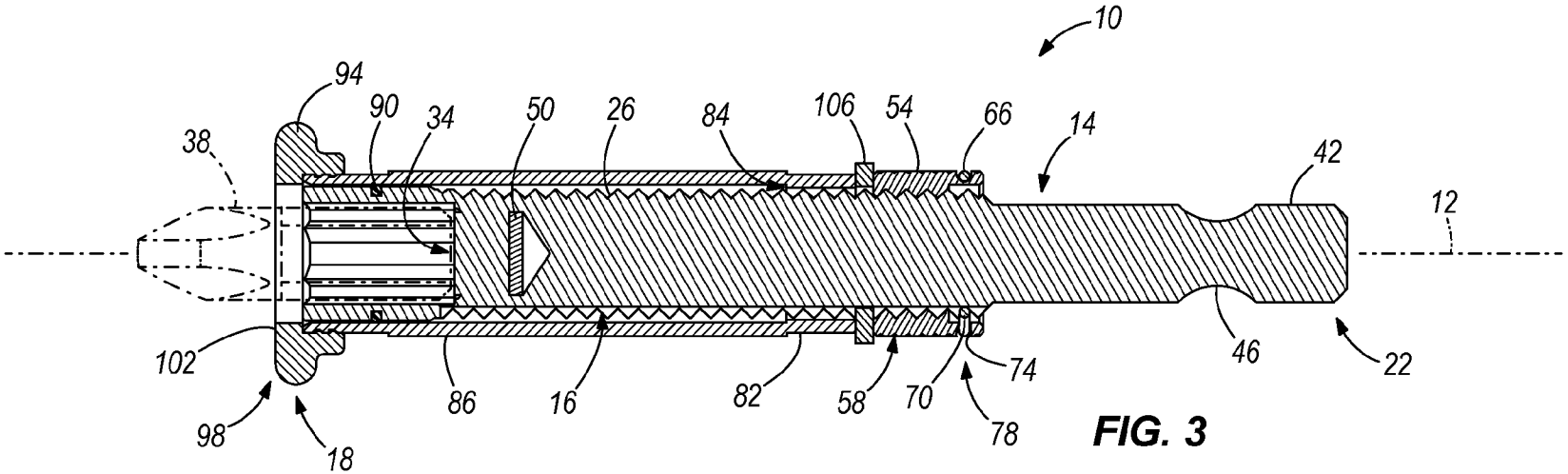
FIG. 3 is a cross section view of the screw guide of FIG. 1 in the retracted position.
Figure 4:
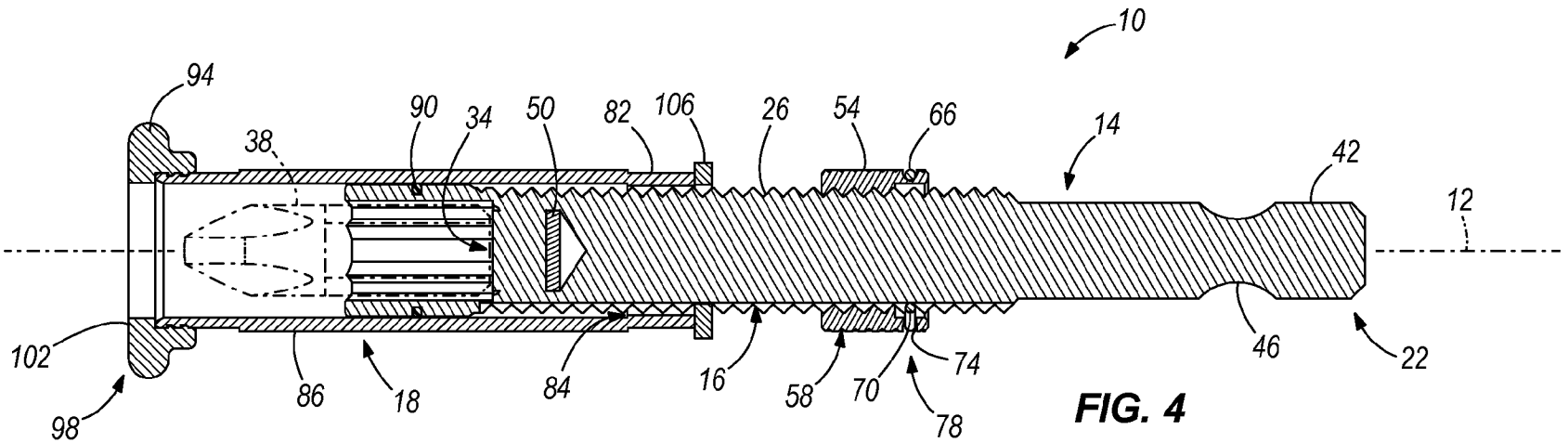
FIG. 4 is a cross section view of the screw guide of FIG. 2 in the extended position.
Figure 5:
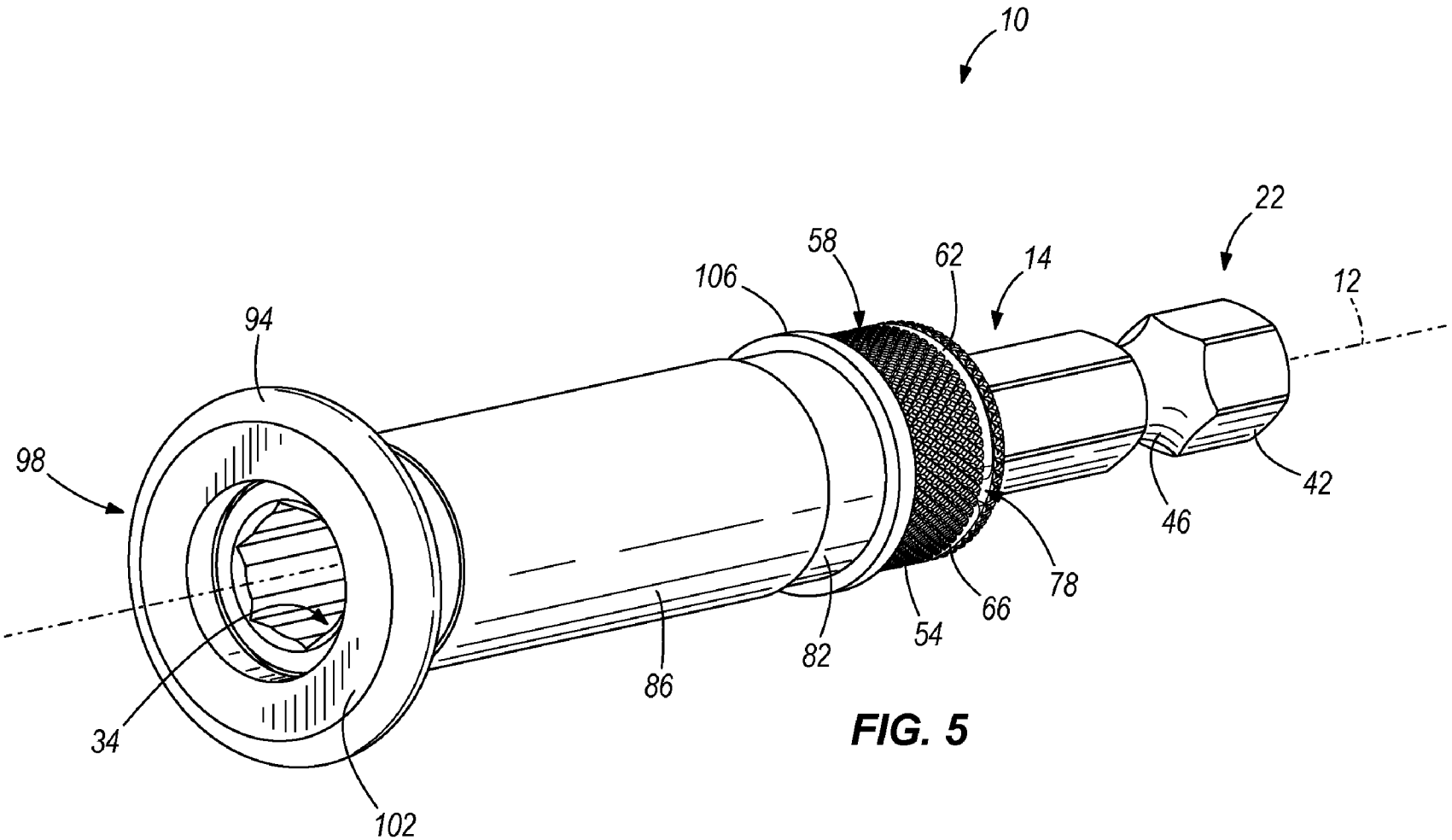
FIG. 5 is a front perspective view of the screw guide of FIG. 1 in the retracted position and with a drive bit removed.

With particular reference to the cross sections of FIGS. 3-4, the shaft 14 includes a first end 18 and a second end 22, the shank portion 42 being at the second end 22. The cylindrical portion 16 includes a threaded portion 26 extending along a portion of the shaft 14 and a recess or bore 34 extending axially into the first end 18 for receiving a removable drive bit, such as the Phillips head screw bit 38 illustrated in FIG. 1 and shown in phantom in FIGS. 3-4. The threaded portion 26 includes a groove 30 (FIGS. 6 and 8) extending axially along a length of the threaded portion 26. The recess 34 is sized to receive the drive bit 38 snugly and has a depth less than a length of the drive bit 38 such that the drive bit 38 extends from the first end 18 of the shaft 14. The recess 34 is shown in perspective in FIG. 5 and is a hexagonal recess in the illustrated construction to receive a hexagonal shaped drill bit. In other constructions, the recess 34 may be another shape suited for receiving a similarly shaped drive bit. Drive bits are known in the art and are commonly found in a variety of shapes and sizes; therefore, the characteristics of the recess 34 are not intended to limit the scope of the invention. Furthermore, the recess 34 may be structured to receive drive bits for use with flat head screws, bolts, or other types of fasteners and is not limited to use with the Phillips head screw bit illustrated in FIGS. 1, 3 and 4.

The second end 22 includes the shank 42 for being grasped by a chuck (not shown) of the external source that provides torque. The illustrated shank 42 includes a neck 46 having a narrowed diameter for being engaged by detent balls in a quick release chuck (not shown). A hexagonal shank 42 is illustrated for being engaged by the chuck. Other shapes and configurations suited for being received by the chuck of the external source are possible and not intended to limit the scope of the invention.

With further reference to FIGS. 3-4, the shaft 14 includes a magnet cavity 50 for receiving a small permanent magnet (not shown). The permanent magnet provides a force to retain the removable drive bit 38, which is typically made of a ferromagnetic material. Other constructions may not employ the permanent magnet and cavity such that the recess 34 may be constructed to receive a non-ferromagnetic removable drive bit.

A depth-adjustment ring 54, which includes a textured, or knurled, exterior surface 58 for providing a grip surface, is threaded onto the threaded portion 26 and includes a groove, referred to herein as ring groove 62, for receiving a detent ring 66. The detent ring 66 includes a projection 70 that extends through an aperture 74 in the depth-adjustment ring 54. The projection 70 engages the groove 30 in the threaded portion 26 to inhibit movement (i.e., rotational movement and therefore also axial movement) of the depth-adjustment ring 54, except when a sufficient torque is applied to the depth-adjustment ring 54. An amount of torque required to rotate the depth-adjustment ring 54 when the detent ring projection 70 engages the groove 30 is greater than an amount of torque required to rotate the depth-adjustment ring 54 when the detent ring projection 70 disengages from the groove 30.

The depth-adjustment ring 54 having the aperture 74, the detent ring 66 and the groove 30 will be collectively referred to herein as a detent mechanism 78. The detent mechanism 78 provides resistance to inhibit the depth-adjustment ring 54 from moving (i.e., rotation and therefore also axial movement) during use of the screw guide 10. In further constructions of the screw guide, other configurations and constructions of the detent mechanism 78 are possible, such as a ball detent mechanism. Furthermore, a mechanism other than a detent may be used to provide the resistance necessary to inhibit rotation of the depth-adjustment ring 54 during use of the screw guide 10.

The depth-adjustment ring 54 may be adjusted manually by applying torque necessary to rotate the depth-adjustment ring 54 in either direction about the central axis 12 and move the depth-adjustment ring 54 axially along the threaded portion 26. In the illustrated construction, one rotation of the depth-adjustment ring 54 corresponds to approximately ⅛ inches of movement in the axial direction. In other constructions, the threads may be sized differently to allow for finer adjustment of the depth-adjustment ring 54, or conversely, for less fine adjustment. In yet other constructions, the threaded portion 26 may include more than one groove to cooperate with the detent mechanism 78 and allow for finer depth adjustment.

Figure 6:
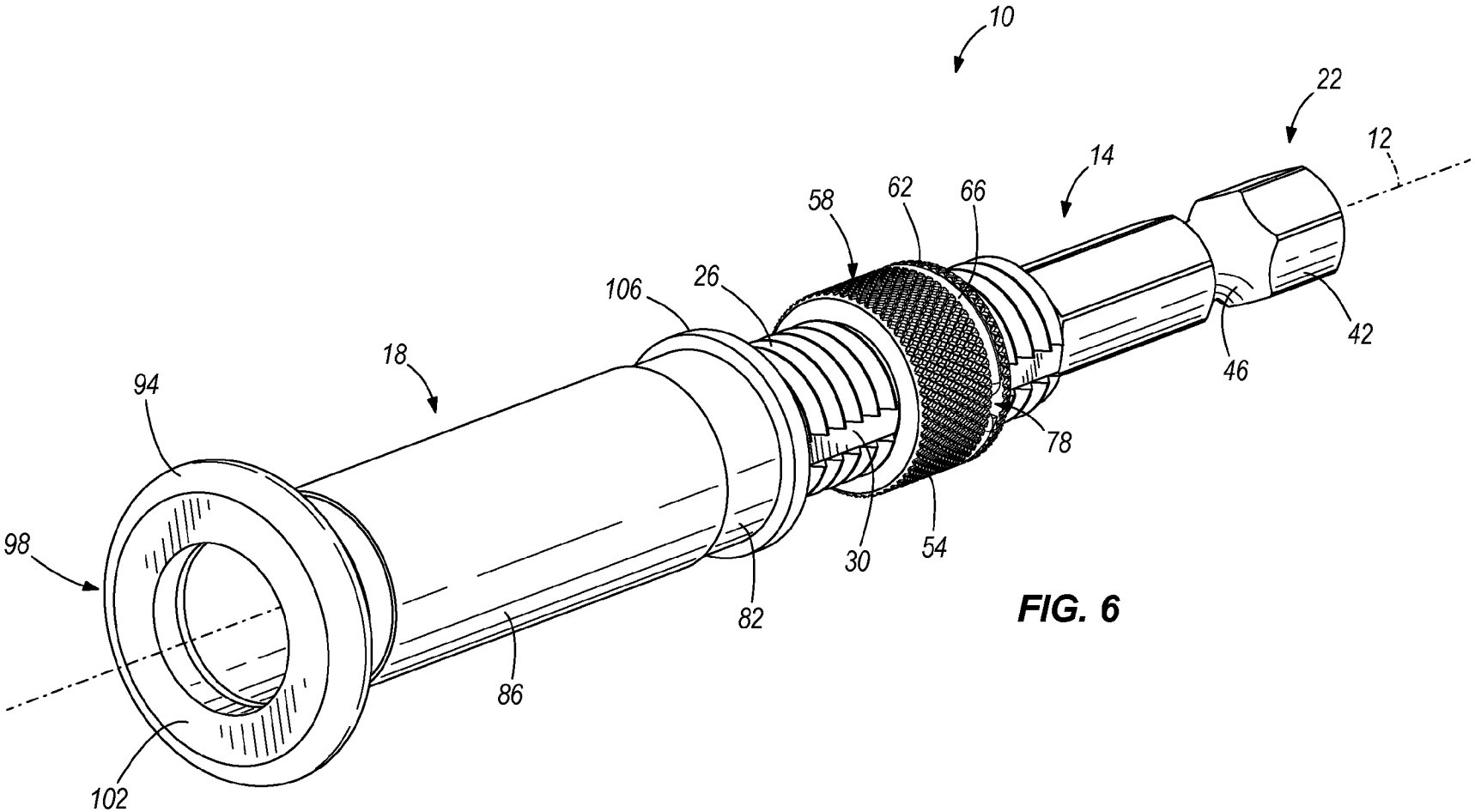
FIG. 6 is a front perspective view of the screw guide of FIG. 2 in the extended position.
Figure 7:
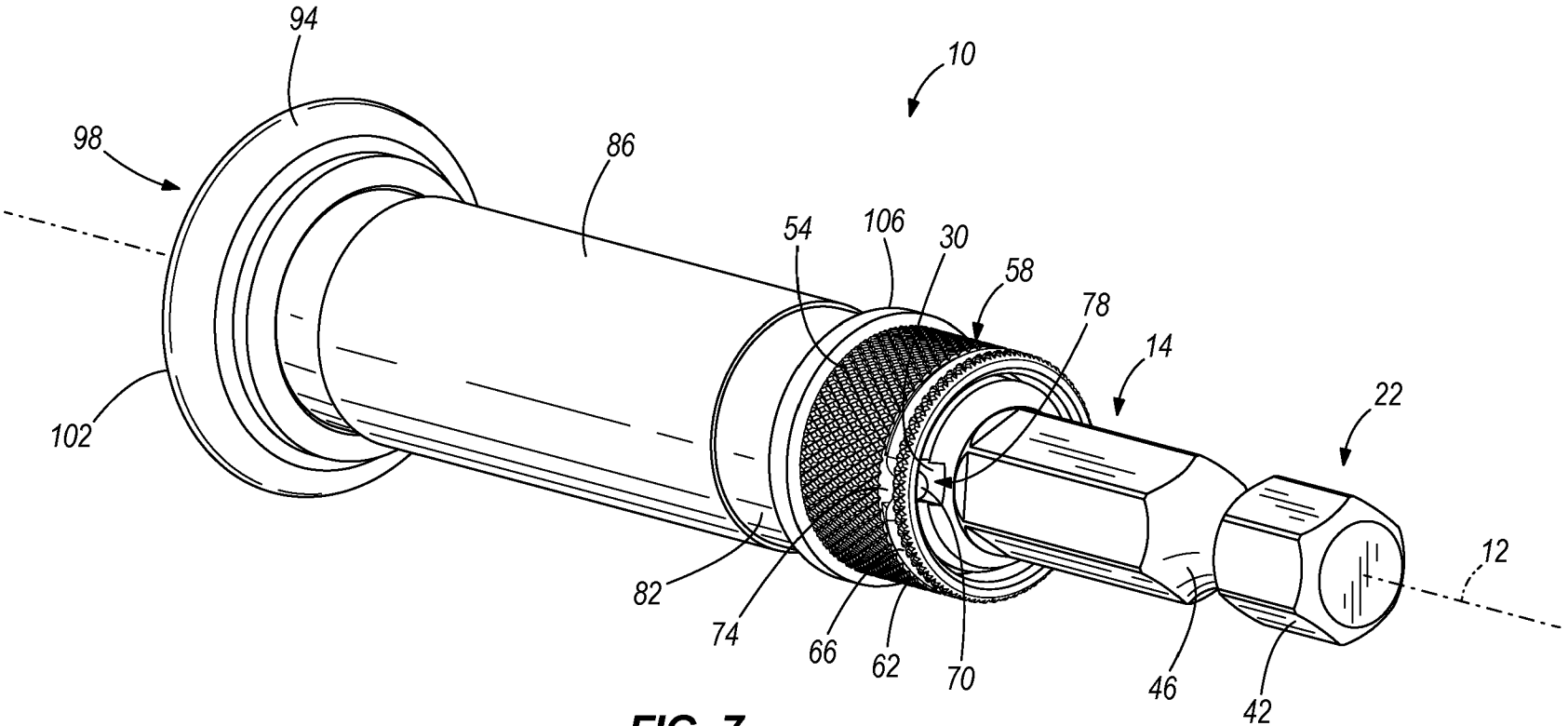
FIG. 7 is a rear perspective view of the screw guide of FIG. 1 in the retracted position.
Figure 8:
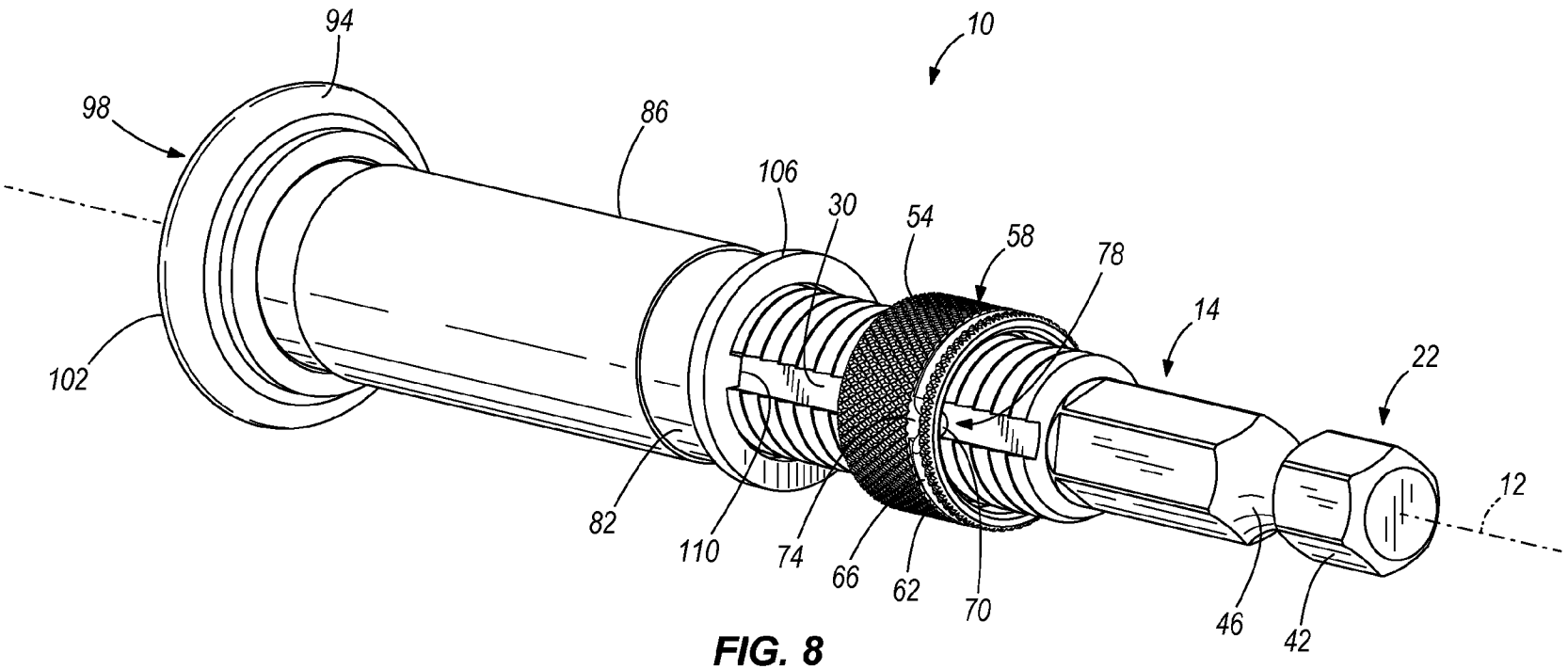
FIG. 8 is a rear perspective view of the screw guide of FIG. 2 in the extended position.

The sleeve 82 is slideably coupled to the shaft 14 for axial movement thereon between the retracted position (FIGS. 1, 3, 5) and the extended position (FIGS. 2, 4, 6). An inner diameter of the sleeve 82 is slightly larger than an outer diameter of the shaft 14 to allow for axial movement of the sleeve 82 while allowing the sleeve 82 to remain coaxially aligned with the shaft 14. The sleeve 82 is preferably made from steel or brass and includes a polymer overmold 86, such as a nylon overmold, but other materials with acceptable characteristics may be employed.

Figure 9:
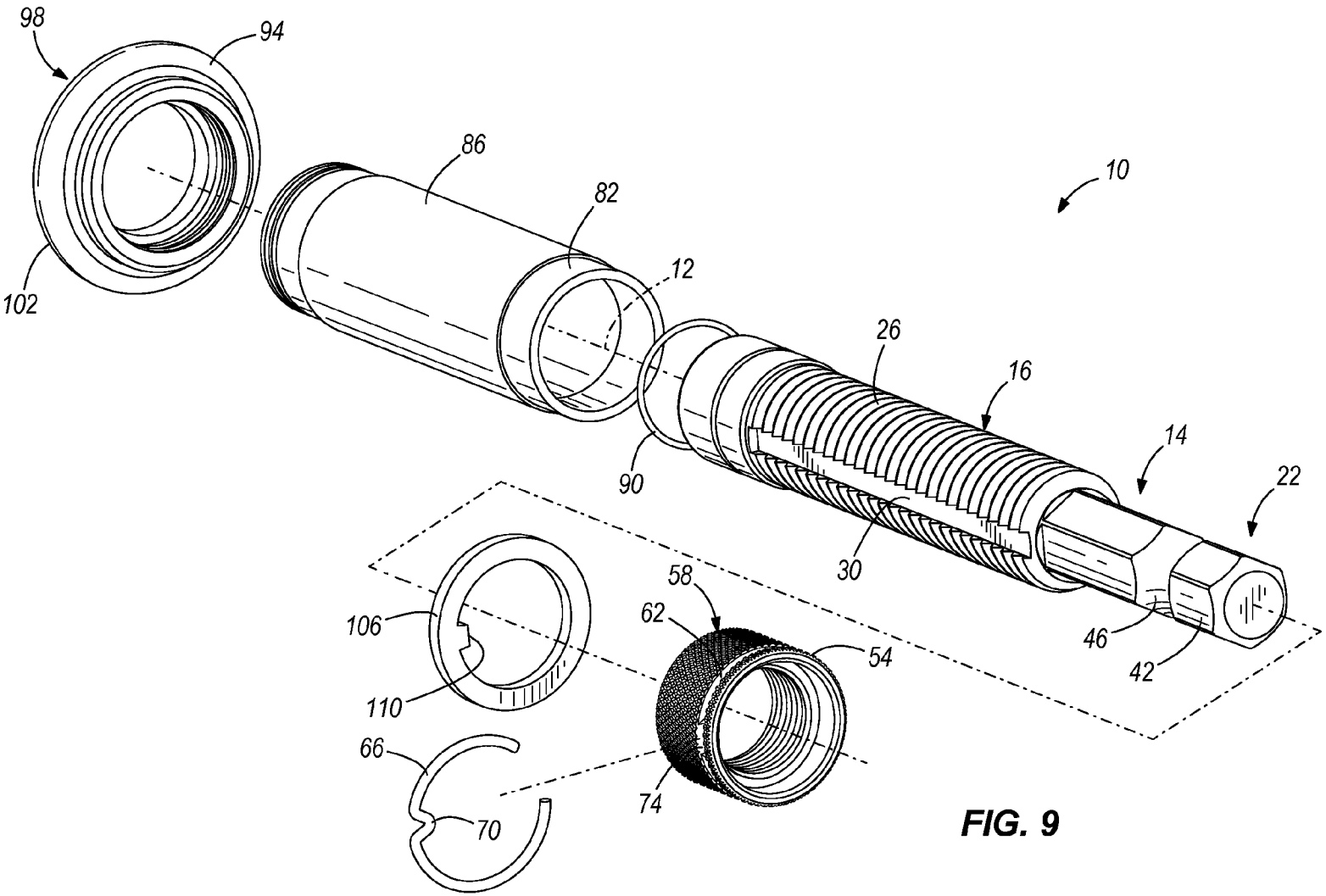
FIG. 9 is an exploded view of the screw guide of FIG. 1.

The anti-rotation ring 106 is positioned between the depth-adjustment ring 54 and the sleeve 82 to prevent direct contact between the depth-adjustment ring 54 and the sleeve 82. The anti-rotation ring 106 reduces the likelihood of the depth-adjustment ring 54 rotating unintentionally, with respect to the shaft 14, if too much axial force is applied to the screw guide 10 between the external source and the workpiece during operation. An inner diameter of the anti-rotation ring 106 is approximately equal to the inner diameter of the sleeve 82 such that the anti-rotation ring 106 slides axially along the outer surface of the shaft 14. The anti-rotation ring 106 includes a locating tab 110 (FIG. 9) dimensioned to fit in the groove 30 and engage the groove 30 to inhibit the ring 106 from rotating in response to a torque. The anti-rotation ring 106 is centered about the axis 12 and installed over the shaft 14 such that the locating tab 110 is radially aligned with the groove 30. The anti-rotation ring 106 is a thin ring preferably having a thickness of about 1.5 to about 2.0 mm so as to not substantially affect the adjustment range of the screw guide 10. In other constructions, the thickness may be greater than 2.0 mm and still be in accordance with the invention, although the adjustment range would be more substantially affected. In other constructions, the screw guide 10 may be constructed without the anti-rotation ring 106.

The shaft 14 includes a stop ring 90 (FIGS. 3 and 4) proximate the first end 18 for engaging an interior surface, or stop surface 84, of the sleeve 82 when the sleeve 82 is fully extended to inhibit the sleeve 82 from separating from the shaft 14. The sleeve 82 has a slightly smaller inner diameter proximate the second end 22 to provide the stop surface 84 (FIGS. 3-4) for engaging the stop ring 90. In the fully retracted position (FIG. 3), the sleeve 82 engages the anti-rotation ring 106 to inhibit further movement of the sleeve 82. The depth-adjustment ring 54 can be adjusted to a desired position in order to stop the sleeve 82 in a position that corresponds to a desired fastener depth or fastener stand-off with relation to the material into which the fastener is driven, as will be described in greater detail below.

The non-marring cap 94, preferably made of a polymer, such as nylon, is coupled to an end 98 of the sleeve 82 that engages the material into which the fastener is driven. The cap 94 includes a lip 102, or flange, that increases a surface area of the screw guide 10 (beyond a diameter of the sleeve 82) for engaging the material into which the fastener is driven. The lip 102 has an outermost diameter that is larger than a diameter of the sleeve 82. The cap 94 being made of a polymeric material and having increased contact area between the screw guide 10 and the material decreases marring or scratching of the material by the screw guide 10. In the illustrated construction, the cap 94 is formed separately and pressed over the end 98 of the sleeve 82 in a tolerance fit. In other constructions, the cap 94 may be glued, overmolded, or coupled to the sleeve 82 in another suitable fashion. In yet other constructions, the cap 94 may be integrally formed with the sleeve 82. In yet other constructions, the entire sleeve may be formed of a polymer with or without a lip.

In operation, the depth-adjustment ring 54 is adjusted to a desired axial position on the threaded portion 26 of the shaft 14 that corresponds to a desired fastener depth or fastener stand-off with relation to the material into which the fastener is driven. The fastener depth is a distance between the fastener head and the surface of the material into which the fastener is being driven when the fastener is driven below the surface of the material, and the fastener stand-off is a distance between the fastener head and the material into which the fastener is being driven when the fastener is not driven all the way into the material. The depth-adjustment ring 54, detent mechanism 78 and groove 30 allow movement of the depth-adjustment ring 54 between several discrete axial positions, resulting in improved repeatability.

With reference to FIGS. 1, 3, 5 and 7, the depth-adjustment ring 54 is adjusted as close to the second end 22 of the shaft 14 as possible, which corresponds to a maximum fastener depth or a minimum fastener stand-off. To decrease the fastener depth or increase the fastener stand-off, the depth-adjustment ring 54 is rotated in order to be moved axially toward the first end 18 such that the sleeve 82 does not fully retract over the threaded portion 26. The depth-adjustment ring 54 is moved axially by rotating the ring 54 by applying a torque sufficient to overcome the resistance provided by the detent mechanism 78. With reference to FIGS. 2, 4, 6 and 8, the depth-adjustment ring 54 is adjusted to an intermediate position corresponding to an intermediate fastener depth, or similarly, an intermediate fastener stand-off.

In operation, the depth-adjustment ring 54 rotates with the external source of torque relative to the sleeve 82 and may engage the anti-rotation ring 106 when the sleeve 82 is fully retracted. The anti-rotation ring 106 also rotates with the external source of torque, and is thus stationary with respect to the depth-adjustment ring 54. In the fully retracted position, the depth-adjustment ring 54 and anti-rotation ring 106 rotate with respect to the sleeve 82 and may engage the sleeve. If enough axial force is provided between the anti-rotation ring 106 and the sleeve during operation, a torque may be applied to the anti-rotation ring 106 through frictional engagement with the sleeve 82. The anti-rotation ring 106 resists rotational movement caused by such torque by way of the locating tab 110, which engages the groove 30. By employing the anti-rotation ring 106, such torque is applied to the anti-rotation ring 106 instead of the depth-adjustment ring 54. Thus, the anti-rotation ring 106 is substantially inhibited from rotating with respect to the depth-adjustment ring 54 and thus is inhibited from transferring the torque that could unintentionally move the depth-adjustment ring 54.

The screw guide 10 is coupled to the external source of torque by way of the second end 22 of the cylindrical member 14, as described above. The removable drive bit 38 is inserted into the recess 34 and a fastener (not shown) is engaged with the drive bit 38. The lip 102 of the cap 94 is positioned to engage material into which the fastener is driven, and the external source is operated to provide torque to the screw guide 10 until the sleeve 82 engages the anti-rotation ring 106, which prevents the fastener from being driven further into the material.

In other constructions, the length of the removable drive bit may differ from the drive bit 38 illustrated in FIG. 1, the distance between the first end 18 of the shaft 14 and the end 98 of the sleeve 82 may be longer or shorter, and the length of the threaded portion 26 may be longer or shorter. In some such cases, it is possible that the position of the depth-adjustment ring 54 illustrated in FIGS. 1, 3, 5 and 7 corresponds to a minimum fastener stand-off.

Although the invention has been described in detail with reference to certain preferred embodiments, variations and modifications exist within the scope and spirit of one or more independent aspects of the invention as described.

Thus, the invention provides, among other things, an auto-stop screw guide adjustable for setting a desired fastener depth or stand-off. Various features and advantages of the invention are set forth in the following claims.

What is claimed is:

1. A fastener guide comprising:

a shaft having a first end for transferring torque to a fastener and a second end for receiving a torque from an external source, the shaft including a threaded portion and an axial groove extending axially along the threaded portion;

a sleeve slidable axially with respect to the shaft, the sleeve having a first end proximate the first end of the shaft and a second end proximate the second end of the shaft; and a depth-adjustment ring having a threaded inner surface for engaging the threaded portion of the sleeve and a detent ring for selectively engaging the axial groove.

2. The fastener guide of claim 1, wherein the shaft further includes a circumferential groove proximate the first end, the fastener guide further comprising a stop ring positioned in the circumferential groove for limiting axial movement of the sleeve.

3. The fastener guide of claim 1, further comprising an end cap disposed at the first end of the sleeve and including a polymeric material.

4. The fastener guide of claim 3, wherein the end cap includes a flange having a diameter larger than a diameter of the sleeve.

5. The fastener guide of claim 1, wherein the depth-adjustment ring includes a textured outer surface for providing a grip.

6. The fastener guide of claim 1, further comprising an anti-rotation ring positioned between the depth-adjustment ring and the sleeve and having a locating tab disposed in the axial groove.

7. The fastener guide of claim 1, wherein the depth-adjustment ring includes a circumferential groove, and wherein the detent ring is disposed in the circumferential groove.

8. The fastener guide of claim 7, wherein the depth-adjustment ring includes an aperture adjoining the circumferential groove, and wherein the detent ring includes a projection disposed in the aperture and selectively engaging the axial groove of the shaft.

9. A fastener guide comprising:

a shaft having a first end for transferring torque to a fastener and a second end for receiving a torque from an external source, the shaft including a threaded portion and an axial groove extending axially along the threaded portion;

a sleeve slidable axially with respect to the shaft, the sleeve having a first end proximate the first end of the shaft and a second end proximate the second end of the shaft;

a depth-adjustment ring having a threaded inner surface for engaging the threaded portion of the shaft and having an outer surface engageable by a user to rotate the depth-adjustment ring; and an anti-rotation ring disposed between the sleeve and the depth-adjustment ring and having a locating tab disposed in the axial groove for inhibiting rotation of the anti-rotation ring;

wherein the outer surface of the depth-adjustment ring is engageable and rotatable by the user while the anti-rotation ring is engaged with the depth-adjustment ring.

10. The fastener guide of claim 9, wherein the shaft further includes a circumferential groove proximate the first end, the fastener guide further comprising a stop ring positioned in the circumferential groove for limiting axial movement of the sleeve.

11. The fastener guide of claim 9, further comprising an end cap disposed at the first end of the sleeve and including a polymeric material.

12. The fastener guide of claim 11, wherein the end cap includes a flange having a diameter larger than a diameter of the sleeve.

13. The fastener guide of claim 9, wherein the outer surface of the depth-adjustment ring includes a textured outer surface for providing a grip.

14. The fastener guide of claim 9, wherein the depth-adjustment ring further comprises a detent ring for selectively engaging the axial groove.

15. The fastener guide of claim 14, wherein the depth-adjustment ring includes a circumferential groove, and wherein the detent ring is disposed in the circumferential groove.

16. The fastener guide of claim 15, wherein the depth-adjustment ring includes an aperture adjoining the circumferential groove, and wherein the detent ring includes a projection disposed in the aperture and selectively engaging the axial groove of the shaft.

17. The fastener guide of claim 9, wherein the depth-adjustment ring includes a first axial surface, wherein the anti-rotation ring includes a second axial surface facing the first axial surface, and wherein the outer surface of the depth-adjustment ring is engageable and rotatable by the user while the first axial surface abuts the second axial surface.

* * * * *

UNITED STATES PATENT AND TRADEMARK OFFICE

CERTIFICATE OF CORRECTION

PATENT NO. : 8,302,513 B2
APPLICATION NO. : 12/717476
DATED : November 6, 2012
INVENTOR(S) : Thomas Evatt It is certified that error appears in the above-identified patent and that said Letters Patent is hereby corrected as shown below:

Col. 6

Claim 1, line 18, “sleeve” should read --shaft--.

Signed and Sealed this
Twenty-ninth Day of January, 2013

David J. Kappos

David J. Kappos
*Director of the United States Patent and Trademark Office*